United States Patent [19]

Masui

[11] Patent Number: 4,812,338

[45] Date of Patent: Mar. 14, 1989

[54] COMBINATION OF ARTIFICIAL FLOWER-FORMING RIBBON AND TACK PLATE

[75] Inventor: Kosuke Masui, Nagoya, Japan

[73] Assignee: Kabushiki Kaisha Aoyama, Nagoya, Japan

[21] Appl. No.: 120,252

[22] Filed: Nov. 10, 1987

Related U.S. Application Data

[63] Continuation-in-part of Ser. No. 929,555, Nov. 12, 1986, Pat. No. 4,725,461.

[51] Int. Cl.[4] ..... A41G 1/00; D04D 7/10

[52] U.S. Cl. ..... 428/4; 428/24; 428/101

[58] Field of Search ..... 428/4, 5, 24, 25, 26, 428/101

[56] References Cited

U.S. PATENT DOCUMENTS

| | | | |
|---|---|---|---|
| 3,630,810 | 2/1969 | Mauro | 428/7 X |
| 4,476,167 | 10/1984 | Duftler | 428/4 |
| 4,476,168 | 10/1984 | Aoyama | 428/4 |
| 4,585,676 | 4/1986 | De Smet et al. | 428/5 |
| 4,634,612 | 1/1987 | Nelson et al. | 428/4 |
| 4,725,461 | 2/1988 | Masui | 428/4 |

*Primary Examiner*—Henry F. Epstein

*Attorney, Agent, or Firm*—Schwartz & Weinrieb

[57] ABSTRACT

A combination of an artificial flower-forming ribbon and a tack plate wherein the ribbon includes a pair of strips overlapped with respect to each other and at least one string disposed along and interposed between the strips, the string being joined to one end of each of the strips at one end thereof, while the strips are adhered to each other at at least two portions on each of a plurality of lines spaced apart in the longitudinal direction of the strips so as to permit relative movement between the strips and the string in order to form the flower petals. The tack plate includes a slit which extends from a central portion thereof to a peripheral edge portion thereof whereby insertion of the strips and/or string into and through the tack plate is simplified and facilitated. A central hole is also provided within the tack plate and in communication with the slit so as to accommodate the string once the same has been inserted within the tack plate. The diameter of the hole is less than the width of the string whereby the string must in effect be rolled up upon itself or otherwise squeezed into the hole, such structural combination serving to retain the string within the hole so as to prevent inadvertent withdrawal of the string from the hole. A surface of the tack plate is also provided with an adhesive film whereby the entire flower assembly may be secured to a support surface, an article to be decorated, article wrapping paper, and the like.

10 Claims, 9 Drawing Sheets

FIG. 13
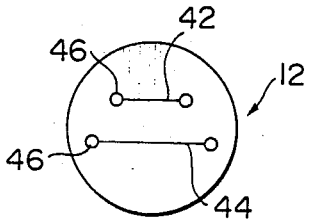
FIG. 14
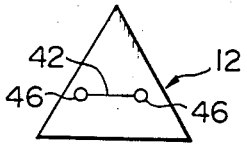
FIG. 15
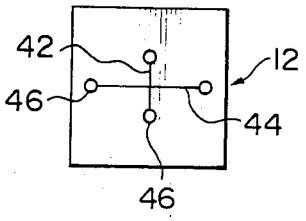
FIG. 16
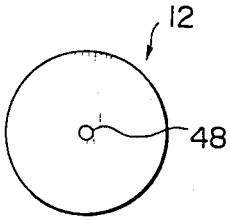
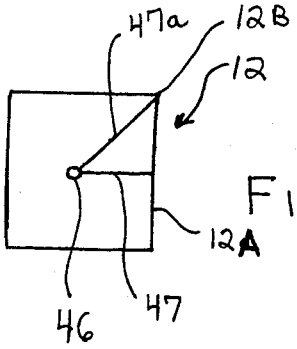
FIG. 16A

COMBINATION OF ARTIFICIAL FLOWER-FORMING RIBBON AND TACK PLATE

CROSS-REFERENCE TO RELATED PATENT APPLICATIONS

This patent application is a Continuation-In-Part patent application of U.S. patent application Ser. No. 929,555 filed on Nov. 12, 1986 now U.S. Pat. No. 4,725,461 .

FIELD OF THE INVENTION

The present invention relates generally to a combination of a ribbon for forming an artificial flower and a tack plate for fastening the ribbon, formed into the artificial flower, to an article or a wrapping thereof or the like.

BACKGROUND OF THE INVENTION

As is often the case, an artificial flower is attached to an article or a wrapping thereof so as to decorate the same for gift-giving purposes.

There has heretofore been proposed a ribbon for forming an artificial flower used for such purposes as disclosed in Utility Model Publication (KOKOKU) No. 14726/1985. The conventional artificial flower-forming ribbon comprises a pair of strips overlapped with respect to each other and a pair of strings disposed along and interposed between the strips. One end of each of the strings is joined to one end of each of the strips. Both strips are joined to each other at at least two portions on each of a plurality of lines spaced apart in the longitudinal direction of the strips so as to permit relative movement between the strips and the strings extending in the longitudinal direction of the strips.

According to the artificial flower-forming ribbon noted above, the ribbon can be formed into an artificial flower by causing the relative movements of the pair of strips and the strings to occur in the longitudinal direction of the ribbon. For example, when causing the relative movement of the strips and the strings by holding the other end of the ribbon lightly in one hand while subsequently drawings the other ends of the strings, interposed between both strips, with the other hand, both strips will be caused to bend outwardly between a plurality of adhesive portions thereof. Each bent strip portion then forms a petal of the artificial flower.

The artificial flower thus formed is fastened to an article to be decorated for gift-giving purposes or a wrapping accommodating the article or gift therein, or the like, by tying the other ends of the strings, extending outwardly from the other ends of the strips, around the article or the like, or by pasting the artificial flower thereon. However, such means of fastening the artificial flower is not always carried out skillfully by appropriate personnel at all times. Therefore, the skill in fastening results in an extreme difference in the decoration effect of the article or the like.

OBJECT OF THE INVENTION

It is therefore an object of the present invention to provide a combination of an artificial flower-forming ribbon and a fastening means thereof which enables anyone at any time to attach the flower-forming ribbon to an article or the like in a skillful manner.

SUMMARY OF THE INVENTION

According to the present invention, there is provided a combination of an artificial flower-forming ribbon having a pair of strips overlapped with respect to each other and at least one string disposed along and interposed between the strips, and a tack plate, wherein one end of the string is joined to one end of each of the strips, the strips are connected to each other at at least two portions of each of a plurality of lines spaced apart in the longitudinal direction of the strips so as to permit relative movement between the strips and the string interposed between the strips, and the tack plate includes a first plate member having at least one slit or hole, through which both of the strips and string are passed, and a second plate member having adhesive films provided upon both surfaces thereof, the second plate member being joined at one surface thereof to the first plate member while one of the strips is passed through the slit or hole of the first plate member.

According to the present invention, the ribbon is integrally coupled with the tack plate by passing the ribbon through the first plate member of the tack plate and pressing the second plate member having the adhesive films provided upon both surface thereof against the first plate member. The tack plate is preferably placed at the other end of the ribbon. The ribbon coupled with the tack plate can then be fastened or secured to the article or the like before or after the ribbon is formed into the artificial flower. When the other surface of the second plate member of the tack plate is pressed against a predetermined portion of the article or the like, the ribbon or artificial flower formed therefrom is fastened to the article or the like due to the presence of the adhesive film provided upon the other surface of the second plate member. The artificial flower may be formed by causing the movement of both strips of the ribbon relative to the string in the longitudinal direction.

The present invention is further characterized by forming the tack plate from a single plate member having at least one slit or hole defined therein, through which both of the strips and string, or only the string, are passed, and an adhesive film provided upon one surface thereof.

According to the present invention, after the ribbon is passed through the tack plate so as to form the artificial flower, one surface of the tack plate is pressed against the article or the like so as to thereby fasten or secure the artificial flower to the article or the like. Part of one strip facing one surface of the tack plate is adhered to a corresponding part of the one surface due to the presence of the adhesive film upon the one surface of the tack plate. Furthermore, the remaining portion of the one surface of the tack plate is adhered to the article or the like.

When the tack plate is passed over the string, part of the string is partially adhered to the corresponding part of the one surface of the tack plate and the remaining portion of the one surface is adhered to the article or the like by pressing the one surface of the tack plate against the article or the like.

In any one of the embodiments noted above, special techniques are no longer necessary for attaching the artificial flower to the article or the like, which operation is in fact performed or carried out by pressing the adhesive film of the tack plate against the article or the like. Accordingly, the attaching operation for securing the artificial flower to the article or the like may be easily performed or carried out by anyone at any time. Still further, the artificial flower may in fact be securely affixed to the article or the like.

BRIEF DESCRIPTION OF THE DRAWINGS

Various other objects, features, and attendant advantages of the present invention may be better understood from the following detailed description, when considered in conjunction with the accompanying drawings, in which like reference characters are used to designate corresponding parts throughout the several views, and wherein:

FIGS. 11, 13, 14, 15, 16, and 16A are plan views, respectively, showing modifications or different embodiments of the tack plate used within the combination system shown in FIGS. 2 and 3;

FIGS. 19 and 20 are bottom plan views, respectively, of the ribbon-tack plate combinations of FIGS. 2 and 3 showing the state of the formed artificial flower, and the tack plates thereof, prior to being fastened or secured to an article or the like.

DETAILED DESCRIPTION OF THE ILLUSTRATED EMBODIMENTS

Figure 1:
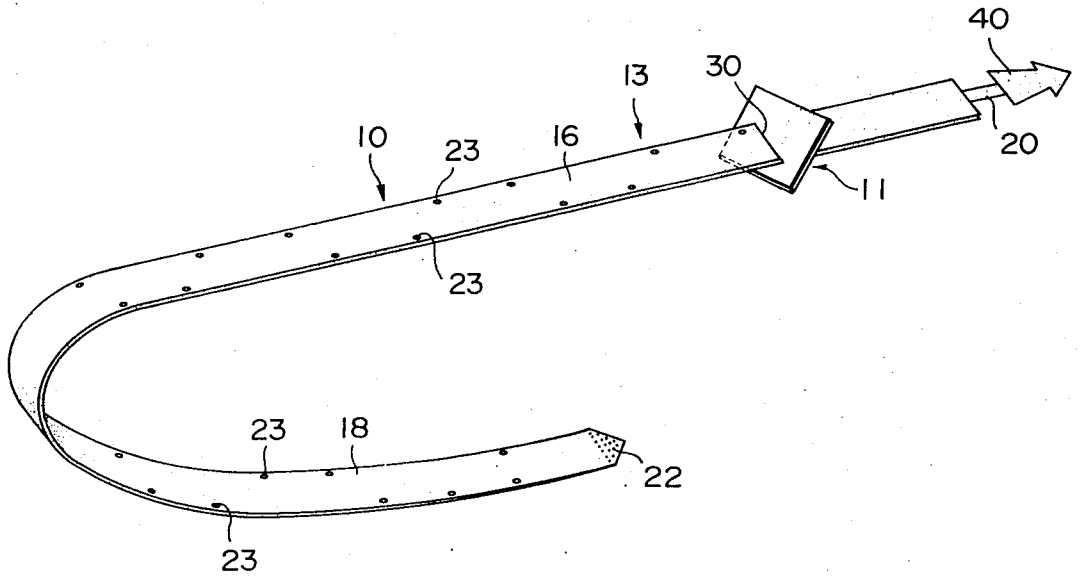
FIG. 1 is a perspective view showing a combination of an artificial flower-forming ribbon and a tack plate associated therewith before formation of the ribbon into the artificial flower in accordance with the present invention.
Figure 2:
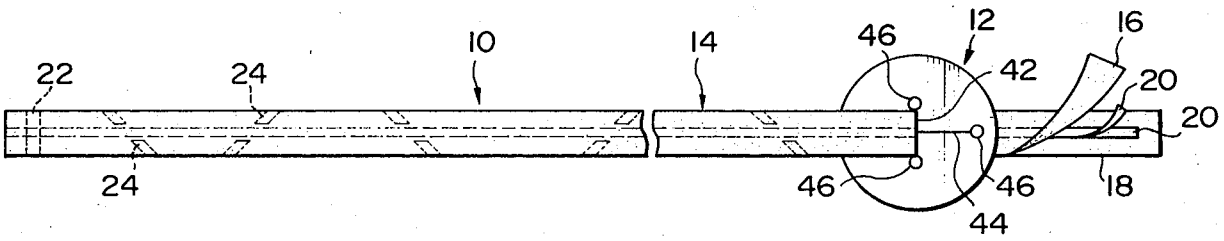
FIGS. 2 and 3 are plan views of the combination of artificial flower-forming ribbons and tack plates similar to the tack plate and ribbon combination shown in FIG. 1.
Figure 3:
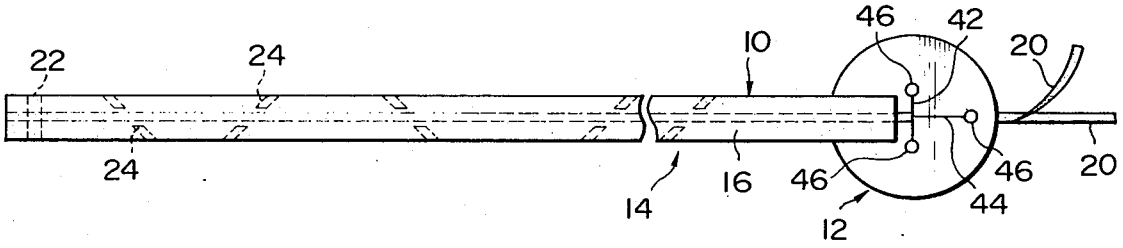

Referring now to the drawings, and more particularly to FIGS. 1–3 thereof, there is illustrated a combination 13 or 14 of an artificial flower-forming ribbon 10 before formation of the artificial flower, and a tack plate 11 or 12, all constructed in accordance with the present invention.

The ribbon 10 includes a pair of elongated strips 16 and 18 which overlap each other, and at least one string 20 disposed along and interposed between both of the strips.

Strips narrower than the width of the strips 16 and 18 and having a material similar to that of the strips 16 and 18 may be used as the string or strings 20. The string 20 is disposed along the longitudinally extending centerline of the strips 16 and 18 as viewed in the widthwise direction thereof.

Both strips 16 and 18 are adhered to each other at joint portions 22 which are provided at respective ends thereof. Furthermore, the string 20 is adhered, at the end thereof, to both strips 16 and 18 at the joint portions 22. The strips 16 and 18 can be formed by folding back a single strip, and in such a case, the strips 16 and 18 are united together at the folded end. Furthermore, the string 20 may be fixed to the joined folded ends of the strips 16 and 18.

Continuing further, the strips 16 and 18 are adhered to each other at at least two portions on each of a plurality of lines, not shown, which are spaced apart in the longitudinal direction of the strips and which extend at an angle with respect to the longitudinally extending centerline of the strips. The joint portion in the embodiment shown in FIG. 1 defines a dotted shape or configuration as represented by the reference character 23, while the joint portion in the embodiment shown in FIGS. 2 and 3 defines a parallelogram shape or configuration as shown by the reference character 24. Two joint portions 23 and 24 on the respective lines are located within an area except for the centerline or middle portion of the strips so as to permit relative movement of the strings 20 with respect to the strips 16 and 18 in the longitudinal direction of the strips.

Figure 5:
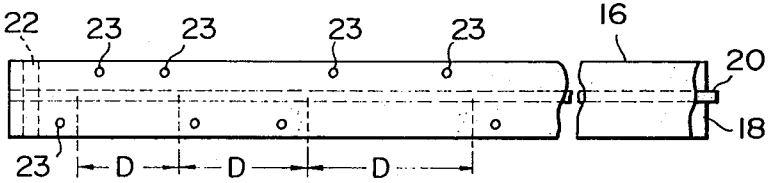
FIGS. 5 and 6 are plan views of the artificial flower-forming ribbon showing adhesive portions thereon at longitudinally spaced intervals thereof.
Figure 6:
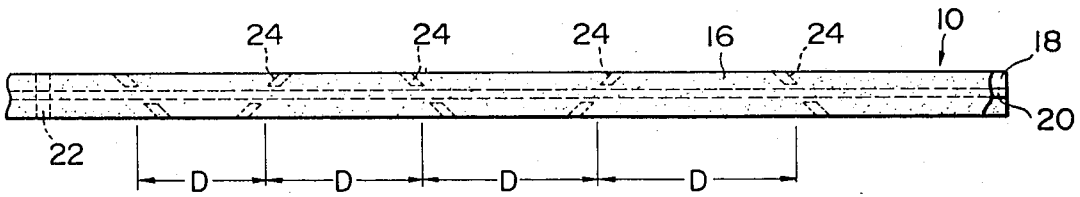

Respective lines on which two joint portions 23 and 24 are disposed are inclined at a predetermined angle, for example, 45°, in the embodiment shown in the drawing with respect to the longitudinal direction of the strips 16 and 18, the inclinations of which are also alternatively reversed. Still further, the inclination angle of each line may be set so as to periodically change between two different angles, such as, for example, from or between 45° and 90°. The inclination angle of each line may be independently set to a desired angle, and therefore, the crossing angle between mutual petals of the artificial flower, which will be described later, and the phase difference defined therebetween, may be changed in accordance with the predetermined angle. Furthermore, the distance D defined between the middle portions of the respective lines adjacent to each other, as seen in FIGS. 5 and 6, gradually lengthens from one end of the strips 16 and 18 toward the other end thereof.

Figure 4:
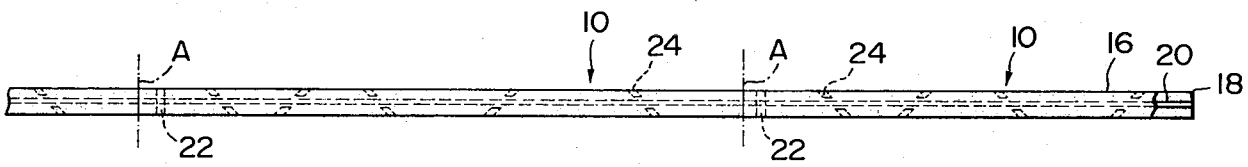
FIG. 4 is a plan view showing a ribbon for successively forming a plurality of artificial flower ribbons before cutting the ribbon into the multiple ribbons.

As an adhesive for the joint portions 22, 23, and 24, a hot-melt adhesive, such as, for example, polyvinyl acetate, is preferred. Furthermore, by using a heat-adhesion means with at least a pair of heat rollers, not shown, having a die for adhering the joints portions 22, 23, and 24, both strips 16 and 18, and the strings 20, may be combined by means of one heat-adhesion process. Still further, successive forming of the ribbon is practicable, and subsequently, a plurality of ribbons 10 may be efficiently produced by cutting a prescribed portion of each ribbon from a continuous ribbon at the junctures A as shown in FIG. 4.

Figure 7:
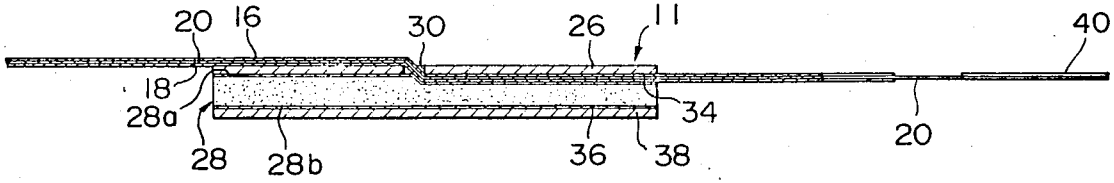
FIG. 7 is a fragmentary longitudinal cross-sectional view showing the ribbon-tack plate combination of FIG. 1.

The tack plate 11 shown in FIG. 1 includes a first plate member 26 and a second plate member 28 as best seen in FIG. 7. The first and second plate members 26 and 28 have the same planar shape respectively and are made from paper, plastic, metal, or the like.

Figure 8:
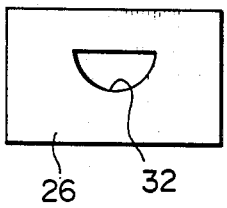
FIGS. 8, 9, and 10 are plan views showing modifications or different embodiments of the first plate member of the tack plate.
Figure 9:
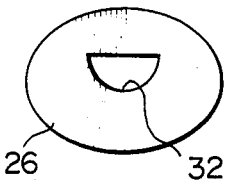
Figure 10:
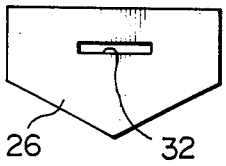

As shown in FIG. 7 in detail, the first plate member 26 has at least one slit 30 or hole 32, as better seen in FIGS. 8–10, defined therein and through which the ribbon, that is, both of the strips 16 and 18, as well as string 20, can be passed. The second plate member 28 has adhesive films 34 and 36 applied to both surfaces 28*a* and 28*b*, respectively. The second plate member 28 is joined by means of its first surface 28*a* to the first plate member 26 and the ribbon 10 is passed through the slit 30 or hole 32 of the first plate member.

The second plate member 28 shown in the drawing is made of an elastic material such as, for example, a foam plastic plate and is compressed in the thickness direction thereof by an amount equal to the thickness of the pair of strips 16 and 18, and string 20, within the adhesive area in contact with the strip 18. The first plate member 26 and ribbon 10 are integrally coupled to each other by means of the second plate member 28. The tack plate 11 is preferably placed within the neighborhood of the other ends of the pair of strips 16 and 18, and to the other surface 28*b* of the second plate member 28 having the entire surface thereof capable of adhering to an article, a wrapping therefor, or the like, if necessary, there is affixed a separable sheet 38 which covers the adhesive film 36, sheet 38 having a planar shape which is similar to that of the second plate member 28 and which may be made from paper, plastic, metal, or the like. The sheet 38 therefore protects the film 36 from damage thereto as a result of any dust or similar substances being otherwise deposited thereon which would tend to reduce the adhesion properties and performance thereof.

The ribbon 10 can be formed into an artificial flower by moving the string 20 relatively with respect to the pair of strips 16 and 18 in the longitudinal direction thereof, as will be described hereinafter. A finger grip 40 is provided upon the other end of the string 20 whereby, when the finger grip 40 is drawn outwardly relative to the strips 16 and 18 while the latter are being held stationary, the string 20 is moved relative to strips 16 and 18. It is to be noted that while finger grip 40 is illustrated, the same may be eliminated or dispensed with as it is not always required.

The first plate member 26 may have a desired planar shape or configuration, such as, for example, that of a rectangle as shown in FIGS. 1 and 8, or an ellipse as shown in FIG. 9, or that of a pentagon as seen in FIG. 10. The hole 32 may also be selected so as to have a desired shape or configuration such as that of a semicircle as seen in FIGS. 8 and 9, or a rectangle as shown in FIG. 10, and still further, may be defined at a predetermined portion within the first plate member 26.

Figure 11:
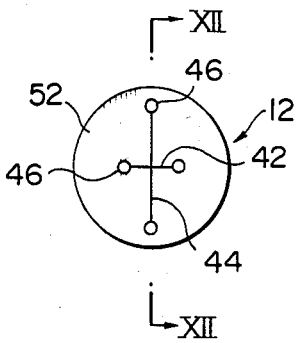

The tack plate 12, as shown in FIGS. 2, 3, and 11, is formed by means of a single plate member having a circular planar shape or configuration, and may be made of paper, plastic, metal, or the like. The tack plate 12 may also have a polygonal planar shape or configuration such as that of a triangle as seen in FIG. 14 or a rectangle as seen in FIG. 15.

The tack plate 12 is provided with at least one slit 42, and the pair of strips 16 and 18 of the ribbon 10, and a pair of strings 20 interposed between the strips, as seen in FIG. 2, or only the pair of strings 20, as seen in FIG. 3, are passed through the slit 42 so as to thereby couple together the ribbon 10 and the tack plate 12. The slit 42 may have a length equal to the width of each of the strips 16 and 18 or the strings 20 passed therethrough, or alternatively, the length of the slit may be smaller than the width of each of the strips or strings. In such a case, the tack plate may not be removable from the strips or strings. Furthermore, the tack plate may be combined with one of a plurality of ribbons having strips or strings which have a width equal to or greater than the length of the slit 42 by providing two slits 42 and 44 having different lengths, respectively, and crossing each other as shown in FIGS. 2, 3 11, and 15, or by the provision of two slits 42 and 44 which are disposed parallel with respect to each other and having the different lengths, respectively, as shown in FIG. 13. As shown in FIG. 14, the number of slits may be one, or three or more slits may be provided. Furthermore, it is preferable that a die cutting hole 46, which communicates respectively with the opposite ends of each slit, be provided, the holes 46 preventing the ends of the slits 42 and 44 from becoming torn.

Continuing still further, instead of a slit being provided, the aperture may be in the form of a rectangular hole, not shown, for example. Alternatively, a circular hole 48 having a diameter equal to or smaller than the width of each of the strings 20 is preferred for a hole through which the strings 20 are to be passed as seen in FIG. 16.

Still yet further, as best seen in FIG. 16A, the tack plate 12 may have a substantially square-shaped configuration similar to the embodiment of FIG. 15, and wherein further, a die cutting hole 46 is also provided at the central portion thereof. In lieu of slits 42 or 44, however, which are defined within interior, non-peripheral edge portions of the tack plate of FIG. 15, the tack plate 12 of FIG. 16 is provided with a slit 47 which extends from central die hole 46 to a peripheral edge portion 12A of the tack plate 12. The advantage of this structural tack plate 12, as compared to the previously disclosed tack plates is that by providing the slit 47 to extend to the peripheral edge portion 12A of the tack plate 12, that edge portion 12A of the tack plate 12 is in effect open or openable in order to enable the insertion therein and therethrough of the flower ribbon strips 16 and 18 and/or strings 20 in a readily easy and simplified manner. In particular, in order to insert the ribbon strips 16 and 18, and/or the strings 20 within and through slit 47 of plate 12, an end or edge portion of the strips or strings may be positioned at the peripheral edge portion or open end of the slit 47 and simply moved or slid radially inwardly toward the central die hole 46 until the strips 16 and 18, and/or the strings 20, are entirely within the die hole 46 or at least have their left edge portions thereof disposed within the vicinity of the die hole 46. This is seen to be a much simpler operation of inserting the strips 16 and 18, and/or strings 20, within and through the tack plate 12 than is true with the tack plates 12 of the previous embodiments because sometimes it proves difficult to manipulate the strips 16 and 18, and/or the strings 20, relative to the tack plates 12 wherein the strips or strings have to be inserted through the slits 42 and/or 44 from, in effect, one surface of the tack plate 12 to the opposite surface thereof. A considerably larger amount of time is also required of such operations as compared to that required in order to complete the assembly operation using the tack plate of FIG. 16A.

Figure 12:
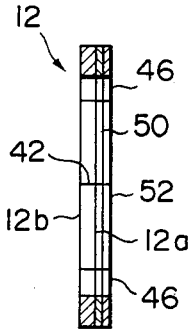
FIG. 12 is a cross-sectional view of the tack plate of FIG. 11 as taken along line XII—XII of FIG. 11.
Figure 17:
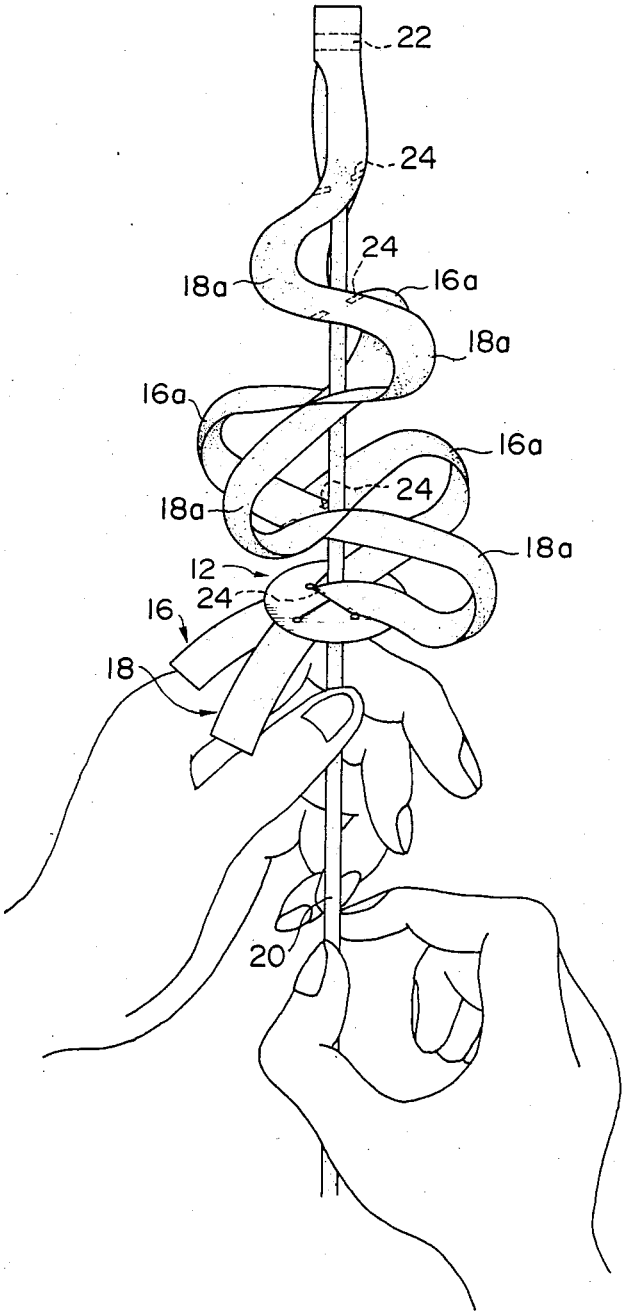
FIG. 17 is a perspective view showing the combination shown in FIG. 2 during the formation of the artificial flower.

Continuing further, and with reference again being made to FIG. 12, an adhesive film 50 is applied to one surface 12*a* of the tack plate 12, and a separable sheet 52 for covering the film 50, and having a planar shape or configuration which is similar to that of the tack plate 12 and which may be made of paper, plastic, metal, or the like, may be applied to the film 50, if necessary or desirable. The sheet 52 of course serves to protect the film 50 from damage which would otherwise occur to the film as a result of the deposition of dust or other similar substances thereon which would tend to reduce the adhesion properties or performance thereof.

The surface 12*a* of the tack plate 12 may be disposed toward either one of the ends of the strips 16 and 18, and is preferably disposed toward those ends of the strips as shown in the illustrated embodiments from the standpoint of readily facilitating the securement of the artificial flower to the article or the like.

The ribbon 10 can be formed into the artificial flower by causing relative movement to occur between the strips 16 and 18, and the strings 20, in the longitudinal direction of the ribbon. For example, the ribbon 10 as shown in FIG. 2 can be formed into the artificial flower by holding the ends of the strings 20, or the ends of the strips 16 and 18, within the vicinity of the other surface 12*b* of the tack plate 12 in one hand and subsequently drawing the other ends of the strings 20 with the other hand. This causes respective portions 16*a* and 18*a* of the pair of strips 16 and 18, located between a plurality of line pairs defining the joint portions 24, to bend outwardly around the joint lines which serve as fold lines, whereby the bent portions 16*a* and 18*a* form the flower petals. Since the petals are oriented by means of the respective joint lines so as to have an inclination angle of 45° with respect to the widthwise or longitudinal directions of the strips 16 and 18, a set of bent portions 16*a* and 18*a* make or define angles of 90° with respect to each other. Moreover, since the inclination angle of the plurality of joint lines is alternately reversed, respective petals 16*a* and 18*a* have a phase difference of 90° with respect to each other. As a result, an artificial flower with considerably uniformly distributed petals 16*a* and 18*a*, in cross-sectional shape or configuration, can be speedily and readily formed as shown in FIG. 18.

Figure 18:
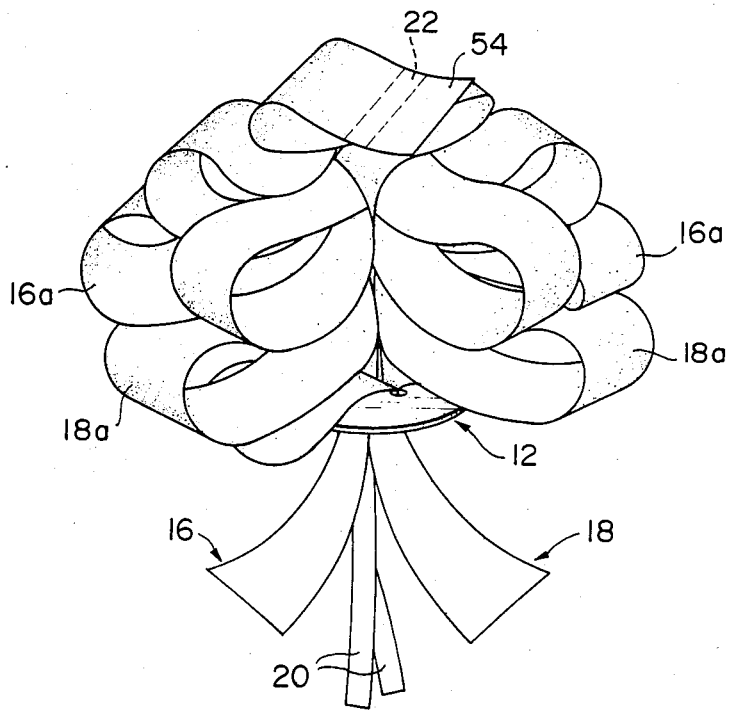
FIG. 18 is a perspective view showing the combination of the ribbon and tack plate after formation of the artificial flower.

Furthermore, since the distance D defined between the respective joint lines gradually lengthens as mentioned above, from one end of each strip toward the other end of each strip 16 and 18, the petals 16*a* and 18*a* gradually shorten from the base of the artificial flower toward the tip portions 54 of the strips as seen in FIG. 18.

Accordingly, while the distances D may be made equal along the length of the strips, the artificial flower looks more natural if the distances D vary so as to increase from the first ends of the strips toward the opposite ends of the strips.

The artificial flower thus formed may be adhered to the surface of an article 56 so as to be affixed thereto by directing the film 50 toward the surface of the article 56 (in the case of the presence of sheet 52, after sheet 52 has been peeled off or removed) and pressing the tack plate 12, disposed upon the other ends of the strips 16 and 18, by means of one's fingers applied to the other surface 12*b* of the tack plate 12. At this time, part of the strip 16 is brought into contact with the surface of the article 56 and part of the strip 18 is adhered to the adhesive film 50. Furthermore, the remaining portion of the film 50 is adhered to the surface of the article 56. As a result of forming a ribbon combination 14 into the artificial flower, it is preferable that the pair of strings 20 extending from the base of the flower be cut at a proper position prior to or after the securement of the artificial flower to the article 56. The residual ends of the pair of strings 20 after cutting, or the residual portion to be cut, is pressed between the other ends of the strips 16 and 18 which are disposed thereagainst.

Figure 19:
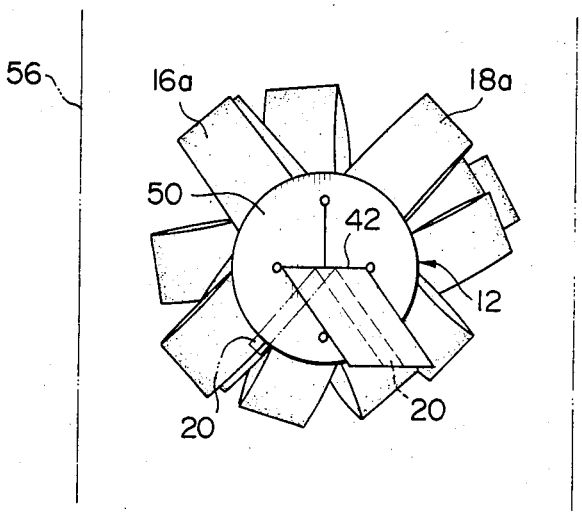

Continuing further, the relative movement of the strips 16 and 18, and strings 20, is subsequently blocked or prevented by means of the frictional forces produced or developed between the tack plate 12 and the article 56 as a result of the adhesion of the artificial flower to the article 56, whereby the bent state of the strips 16 and 18 constituting the flower petals is maintained. On the other hand, it is to be noted that when an external force greater than the frictional force noted acts upon the artificial flower, the bent state of the strips 16 and 18 constituting the flower petals is liable to be partially eliminated. In order to avoid or prevent this from occurring, it is preferable that when pressing the tack plate 12 against the article, at least one of the strings 20 is pulled laterally outwardly from its normal position interposed between the pair of strips 16 and 18, as shown by the two-dot chain lines in FIG. 19, and additionally secured between the tack plate 12 and the article 56 by means of the residual adhesive film portion of the tack plate 12. Alternatively, the other strip 18 may be folded backwardly upon itself so as to expose the strings 20 whereby one or both of the strings 20 can be adhered to the adhesive film 50 of the tack plate 12 along with the other strip 18. In either case, the relative movement between the strips 16 and 18, and the strings 20, is completely blocked or prevented.

Figure 20:
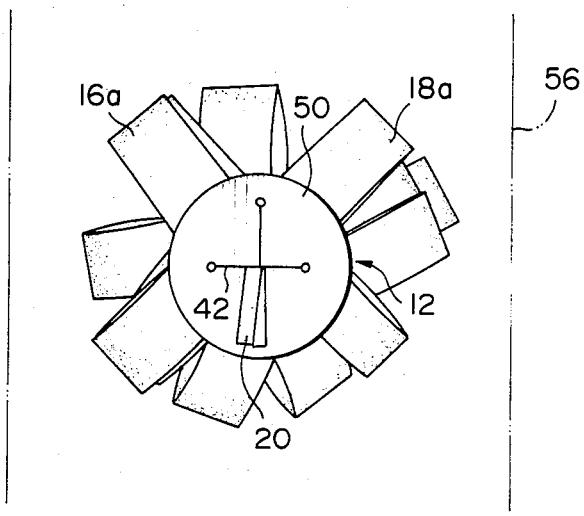

Still yet further, as shown in FIG. 20, in accordance with the embodiment of the ribbon flower in which only the pair of strings 20 is passed through the slit 42 of the tack plate 12, after formation of the ribbon into the artificial flower, the artificial flower may be fastened or secured to the article 56 by pressing one surface of the tack plate 12 against the article 56. At this time, part of the pair of strings 20 is adhered to part of the adhesive film 50 of the tack plate 12 while the remaining portion of the film 50 is adhered to the article 56. In this embodiment, since part of the pair of strings 20 is adhered to the surface 12*a* of the tack plate 12 while the other surface 12*b* of the tack plate 12 is, in effect, pressed against the first joint portion 24 which is located closest to the free ends of the strips 16 and 18 and yet disposed upon the side of tack plate 12 which faces the surface 12*b* thereof, the strips 16 and 18 are, in effect, fixedly locked to tack plate 12 whereby relative movement between the strings 20, and the strip 16 and 18, may not be produced. In addition, in accordance with this embodiment, it is preferable to cut the pair of strings 20 at a proper position before or after the artificial flower is fastened to the article 56.

Thus it may be seen that the present invention enables or readily facilitates the easy and simple fabrication of an artificial flower from the ribbon strips and string combination disclosed in accordance with the present invention, as well as the fixation of the artificial flower so formed onto an article, package, wrapping, or the like. Still further, in accordance with the particular teachings of the invention which constitutes the subject matter of this patent application, insertion of the flower ribbons and strings into and/or through the tack plate is in fact readily facilitated and its simplicity enhanced by the provision of the tack plate slit which extends between the central portion of the tack plate and a peripheral edge portion thereof. In this manner, the ribbons and strings may be easily inserted from the side or peripheral edge portion of the tack plate into the central hole portion thereof as opposed to requiring the insertion of the strips and strings through a slit portion of the tack plate which is disposed or defined within a central, non-peripheral edge portion of the tack plate whereby the strips and strings must be, in effect, passed from one planar surface of the tack plate to the other or opposite planar surface of the tack plate. Still further, by disposing or defining the die hole 46 within the central portion of the tack plate, and still further, in particular, by providing or fabricating the strings of the ribbon-string assembly so as to have a width which is greater than the diameter of the central hole 46 of the tack plate, the strings may be accommodated within the hole 46, in a rolled-up or squeezed fashion, whereby inadvertent removal of the strings from the hole 46, and from the tack plate, is effectively prevented.

Obviously, many modifications and variations of the present invention are possible in light of the above teachings. For example, in lieu of the tack plate 12 of FIG. 16A being square in configuration, other geometrical configurations are of course contemplated within the scope of the present invention, such as, for example, the circular plate of FIG. 16, the triangular plate of FIG. 14, and the like. In addition, it is also to be noted that, as illustrated in FIG. 16A, the slit extending outwardly from the central die hole 46 need not necessarily intercept a peripheral edge portion 12A of the tack plate 12, but may in a similar or conceptual manner intercept a corner portion 12B of the tack plate so as to define a slit 47*a*. The same beneficial results are obtained whereby sliding of the ribbon-string assembly from an outer or free-edge portion of the tack plate 12 into the central region thereof is in fact still facilitated. It is therefore to be understood that within the scope of the appended claims, the present invention may be practiced otherwise than as specifically described herein.

What is claimed as new and desired to be protected by means of Letters Patent of the United States of America, is:

1. In combination, an artificial flower-forming ribbon and a tack plate therefor, comprising:

an artificial flower-forming ribbon having a pair of strips overlapped with respect to each other and at least one string disposed along and interposed between said pair of strips, said at least one string being joined to one end of each of said strips at one end thereof, said strips being adhered to each other at at least two portions on each of a plurality of lines spaced apart in the longitudinal direction of said strips so as to permit relative movement of said strips and said at least one string interposed between said strips; and a tack plate including a slit, extending from a central portion of said tack plate to a peripheral edge portion of said tack plate, through which either said pair of strips or said at least one string is passed, and adhesive means provided upon one surface of said tack plate for securing said tack plate to a support surface.

2. The combination as set forth in claim 1, wherein: said tack plate has the configuration of a square.

3. The combination as set forth in claim 2, wherein: said slit extends from a central portion of said square to a side edge portion of said square.

4. The combination as set forth in claim 1, further comprising:

a hole defined within said central portion of said tack plate and in communication with said slit so as to accommodate said at least one string when said at least one string is passed through said slit from said peripheral edge portion of said tack plate to said central portion of said tack plate.

5. The combination as set forth in claim 2, wherein: said slit extends from a central portion of said square to a corner portion of said square.

6. The combination as set forth in claim 4, wherein: the diameter of said hole is smaller than the width of said at least one string.

7. The combination as set forth in claim 1, further comprising:

separable sheet means separably mounted upon said tack plate so as to protectively cover said adhesive means provided upon said one surface of said tack plate.

8. The combination as set forth in claim 1, wherein: said plurality of lines are disposed at angles of 45° with respect to the longitudinal extent of said strips.

9. The combination as set forth in claim 1, wherein: the distance between said plurality of lines gradually lengthens along the longitudinal extent of said strips.

10. The combination as set forth in claim 1, wherein: alternative ones of said plurality of lines are disposed at angles of 45° and 135°, respectively, with respect to the longitudinal extent of said strips.

* * * * *